US008158876B2

(12) United States Patent
Kitajima et al.

(10) Patent No.: US 8,158,876 B2
(45) Date of Patent: Apr. 17, 2012

(54) KEYBOARD APPARATUS

(75) Inventors: Mitsuru Kitajima, Hamamatsu (JP); Hirotsugu Suzuki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 36 days.

(21) Appl. No.: 12/563,030

(22) Filed: Sep. 18, 2009

(65) Prior Publication Data

US 2010/0071532 A1 Mar. 25, 2010

(30) Foreign Application Priority Data

Sep. 25, 2008 (JP) ..... 2008-245797

(51) Int. Cl.
*G10H 1/32* (2006.01)

(52) U.S. Cl. ..... 84/743; 84/423 R

(58) Field of Classification Search ..... 84/743, 84/235, 423 R, 434, 433, 439, 440
See application file for complete search history.

(56) References Cited

U.S. PATENT DOCUMENTS

| | | | | |
|---|---|---|---|---|
| 3,101,640 | A | 8/1963 | Hartman | |
| 4,993,305 | A * | 2/1991 | Franz et al. | 84/439 |
| 5,062,342 | A * | 11/1991 | Nagatsuma | 84/744 |
| 5,243,125 | A * | 9/1993 | Yamaguchi | 84/745 |
| 5,249,497 | A * | 10/1993 | Niitsuma | 84/247 |
| 5,574,241 | A * | 11/1996 | Kumano et al. | 84/439 |
| 5,610,352 | A * | 3/1997 | Yamaguchi | 84/435 |
| 5,696,340 | A * | 12/1997 | Ragni | |
| 5,821,443 | A * | 10/1998 | Masubushi | 84/433 |
| 5,834,668 | A | 11/1998 | Kumano et al. | |
| 6,147,290 | A * | 11/2000 | Uno | |
| 7,141,729 | B2 | 11/2006 | Uno et al. | |
| 7,208,668 | B2 * | 4/2007 | Shimoda | |
| 7,485,798 | B2 * | 2/2009 | Nishida | |
| 7,541,532 | B2 * | 6/2009 | Osuga et al. | |
| 7,586,030 | B2 * | 9/2009 | Nishida | |
| 7,692,089 | B2 * | 4/2010 | Nishida | |
| 7,709,718 | B2 * | 5/2010 | Osuga | |
| 7,750,222 | B2 * | 7/2010 | Osuga | |
| 7,816,598 | B2 * | 10/2010 | Ishihara et al. | |

(Continued)

FOREIGN PATENT DOCUMENTS

CN 1551100 A 12/2004

(Continued)

OTHER PUBLICATIONS

European Search Report mailed Dec. 28, 2009, for EP Application No. 09170512.9, eight pages.

(Continued)

*Primary Examiner* — Jianchun Qin
(74) *Attorney, Agent, or Firm* — Morrison & Foerster LLP

(57) ABSTRACT

A keyboard apparatus having hammers each adapted for contact at its mass-unconcentrated half with a lower surface of an initial stopper that restricts initial pivot positions of the hammers, thereby reducing a contact force with which each hammer contacts the initial stopper, whereby the required thickness of the initial stopper can be reduced and height positions of key-depression surfaces of the keys in a non-key-depression state can be made uniform with ease. In the non-key-depression state, the hammers are in contact with the lower surface of the initial stopper mounted to a stopper mounting portion of the frame, whereby initial pivot positions of the hammers in a key-depression forward stroke are restricted and key-depression initial positions of respective keys are indirectly restricted, so that the height positions of key-depression surfaces of the keys are made uniform.

9 Claims, 4 Drawing Sheets

U.S. PATENT DOCUMENTS

| | | | |
|---|---|---|---|
| 2004/0261598 | A1* | 12/2004 | Uno et al. |
| 2010/0000394 | A1* | 1/2010 | Komatsu et al. |
| 2010/0071534 | A1* | 3/2010 | Kitajima et al. |

FOREIGN PATENT DOCUMENTS

| | | | |
|---|---|---|---|
| EP | 0 384 120 | A2 | 8/1990 |
| EP | 0 384 120 | A3 | 8/1990 |
| JP | 7-181959 | | 7/1995 |
| JP | 11175054 | | 7/1999 |

OTHER PUBLICATIONS

Chinese Office Action mailed May 12, 2011, for CN Patent Application No. 200910178034.9, with English Translation, 20 pages.

* cited by examiner

KEYBOARD APPARATUS

BACKGROUND OF THE INVENTION

1. Field of the Invention

The present invention relates to a keyboard apparatus having a frame integrally formed by resin and pivotably supporting a plurality of keys, and more particularly, to a keyboard apparatus having hammers supported on a frame so as to each pivot in conjunction with a corresponding key and impart inertia to the key.

2. Description of the Related Art

Conventionally, keyboard apparatuses have been known in which a frame integrally formed by resin and pivotably supporting a plurality of keys is adapted to be supported on a musical instrument main body. Among these, some keyboard apparatus includes hammers supported on the frame and each adapted to pivot in conjunction with a corresponding key and impart inertia to a pivotal motion of the key (Japanese Patent Publication No. 3819136 and Japanese Laid-open Patent Publication No. 7-181959).

In the keyboard apparatuses disclosed in Japanese Patent Publication No. 3819136 and Japanese Laid-open Patent Publication No. 7-181959, each hammer is adapted to be driven by the corresponding key so as to pivot about a hammer support, and a stopper is provided at either a lower rear part or a lower front part of the frame. In a non-key-depression state, the hammers are in contact with an upper surface of the stopper at their one end portions (contact parts) where the hammer's mass is concentrated, whereby initial pivot positions of the hammers are restricted and key-depression initial positions of respective keys are indirectly restricted.

Therefore, height positions of key-depression surfaces (i.e., upper surfaces) of the keys in the non-key-depression state are determined by contact states between the stopper and the contact parts of the hammers.

In the keyboard apparatus disclosed in Japanese Patent Publication No. 3819136, since the distance between the contact part of each hammer and the corresponding hammer support is long, the contact part is caused to come into contact with the stopper at high speed when the hammer restores to its initial pivot position. Thus, the stopper is liable to be deformed due to repetitive restoration motions of the hammers, resulting in a variation between the height positions of the key-depression surfaces of the keys. If the thickness of the stopper is thickened to suppress the stopper deformation, the stopper thickness tends to greatly vary between different portions of the stopper, causing a variation between the height positions of the key-depression surfaces of the keys.

If the distance between the hammer support and the contact part of each hammer is long, warpage and deformation of the hammer in a region between the hammer support and the contact part affect the key-depression initial position of the corresponding key, resulting in a variation between the height positions of the key-depression surfaces of the respective keys.

SUMMARY OF THE INVENTION

The present invention provides a keyboard apparatus comprising hammers each adapted for contact at its mass-unconcentrated half with a lower surface of an initial stopper that restricts initial pivot positions of the hammers, thereby reducing a contact force with which each hammer contacts the stopper, whereby the required thickness of the initial stopper can be reduced, and height positions of key-depression surfaces of respective keys in a non-key-depression state can easily be made uniform.

According to a first aspect of the present invention, there is provided a keyboard apparatus, which comprises a frame having a key support and hammer supports and integrally formed by resin, the frame being adapted to be supported on a musical instrument main body, a plurality of keys mutually juxtaposed and each supported by a corresponding one of the key supports for pivotal motion when depressed, a plurality of hammers mutually juxtaposed so as to correspond to respective ones of the keys, each of the hammers being supported by a corresponding one of the hammer supports at a location below the corresponding key so as to pivot about the hammer support in conjunction with the corresponding key and impart inertia to a pivotal motion of the key, an initial stopper having a lower surface and provided on the frame integrally therewith or separately therefrom, and an initial-stopper mounting portion integrally formed on the frame and mounted with the initial stopper, wherein the hammers are adapted to be in contact with the lower surface of the initial stopper in a non-key-depression state, whereby initial pivot positions of the hammers in a key-depression forward stroke are restricted to thereby restrict key-depression initial positions of the keys.

According to a second aspect of the present invention, there is provided a keyboard apparatus, which comprises a frame having a key support and hammer supports and integrally formed by resin, the frame being adapted to be supported on a musical instrument main body, a plurality of keys mutually juxtaposed and each supported by a corresponding one of the key supports for pivotal motion when depressed, a plurality of hammers mutually juxtaposed so as to correspond to respective ones of the keys, each of the hammers being supported by a corresponding one of the hammer supports at a location below the corresponding key so as to pivot about the hammer support in conjunction with the corresponding key and impart inertia to a pivotal motion of the key, an initial stopper having a lower surface and provided on the frame integrally therewith or separately therefrom, and an initial-stopper mounting portion integrally formed on the frame and mounted with the initial stopper, wherein the hammers each have a first half having a mass concentrated portion and a second half located on a side opposite from the first half with respect to a corresponding one of the hammer supports, and the second halves of the hammers in a non-key-depression state are adapted to be in contact with the lower surface of the initial stopper due to own weights of the hammers, whereby initial pivot positions of the hammers in a key-depression forward stroke are restricted to thereby restrict key-depression initial positions of the keys.

With the present invention, each hammer is adapted for contact at its mass-unconcentrated half with the lower surface of then initial stopper that restricts initial pivot positions of hammers, whereby a contact force with which each hammer contacts the initial stopper can be reduced. As a result, the required thickness of the initial stopper can be reduced, and height positions of key-depression surfaces of the keys in the non-key-depression state can be made uniform with ease.

Preferably, the hammers each have a stopper contacting portion adapted to be in contact with the lower surface of the initial stopper in the non-key-depression state, and a distance from the stopper contacting portion of each of the hammers to a corresponding one of the hammer supports is shorter than a distance from the hammer support to a center of gravity of the hammer.

In that case, it is possible to reduce affections of warpage and deformation of each hammer in a region from the hammer support to the stopper contacting portion upon the height position of the key-depression surface of the corresponding key, and it is also possible to reduce a speed at which the stopper contacting portion of the hammer contacts the initial stopper, whereby deformation of the initial stopper and non-uniformity between height positions of the key-depression surfaces can be suppressed.

Preferably, the hammers each have a driven portion adapted to be driven by the corresponding key so as to pivot in conjunction with the key, and the hammers each have a stopper contacting portion on a side opposite from a corresponding one of the hammer supports with respect to the driven portion of the hammer, the stopper contacting portion being adapted to be in contact with the lower surface of the initial stopper in the non-key-depression state.

In that case, some appropriate length of each hammer between the hammer support and the stopper contacting portion can be ensured, whereby affections of a variation in thickness between different portions of the initial stopper upon the height positions of the key-depression surfaces can be reduced.

Preferably, there are provided with an end stopper provided on the frame integrally therewith or separately therefrom and adapted for contact with the hammers to thereby restrict key-depression end positions of the keys in the key-depression forward stroke, and an end-stopper mounting portion integrally formed on the frame and mounted with the end stopper, wherein both the initial-stopper mounting portion and the end-stopper mounting portion are positioned upward of the hammer supports.

In that case, the hammers can easily be assembled to the frame.

Preferably, there are provided with an end stopper provided on the frame integrally therewith or separately therefrom and adapted for contact with the hammers to thereby restrict key-depression end positions of the keys in the key-depression forward stroke, and an end-stopper mounting portion integrally formed on the frame and mounted with the end stopper, wherein the initial-stopper mounting portion and the end-stopper mounting portion are respectively positioned on opposite sides of the hammer supports as viewed in a longitudinal direction.

In that case, the frame can easily be integrally formed.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First Embodiment

Figure 1:
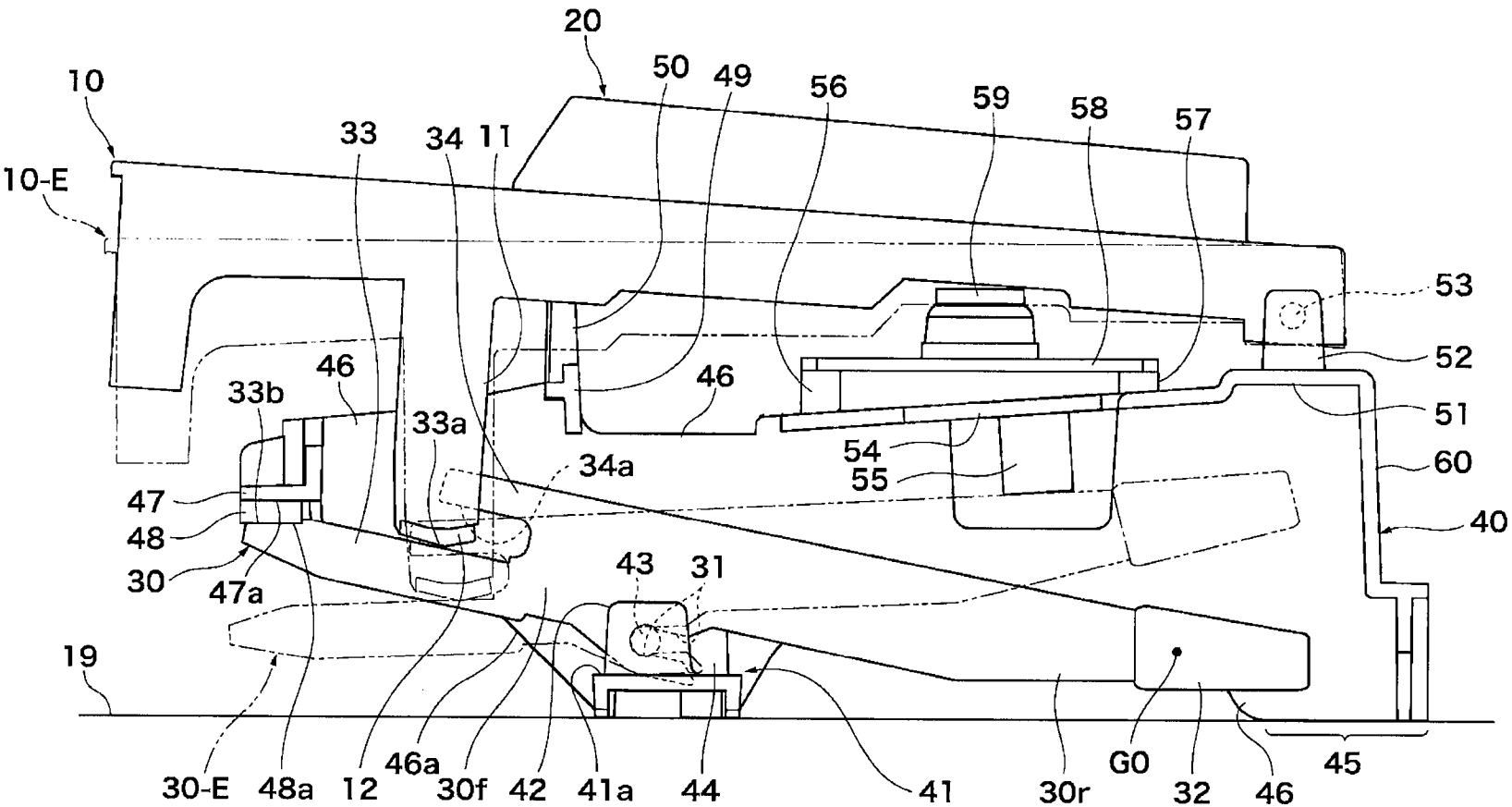
FIG. 1 is a side view showing the internal construction of a keyboard apparatus according to a first embodiment of this invention.

FIG. 1 shows in side view the internal construction of a keyboard apparatus according to a first embodiment of this invention. The keyboard apparatus is for use in, for example, an electronic keyboard instrument, and has a frame 40 which is integrally formed by resin and on which white keys 10, black keys 20, and hammers 30 are mounted. In the following, a side of the keyboard apparatus toward a player and an opposite side thereof (the left and right sides in FIG. 1) will be referred to as the front and rear sides of the apparatus, and the left-to-right direction will be determined in reference to the player.

The white and black keys 10, 20 are mutually juxtaposed in the left-to-right direction (which is also referred to as the key arrangement direction), and the hammers 30 are mutually juxtaposed in the key arrangement direction. The hammers 30 are arranged so as to correspond to respective ones of the keys, and each hammer is disposed below the corresponding key and imparts inertia to a pivotal motion of the key.

The white and black keys 20 are supported on key supports 53 of the frame 40 such that their front ends are vertically pivotable about the key supports 53. The key supports 53 may be of any construction capable of pivotably supporting the keys 10, 20. In a case, for example, that each key 10 or 20 is of a hinge-type having a key main body connected via a hinge to a proximal end of the key, portions of the frame 40 which respectively fixedly support the proximal ends of the keys constitute the key supports 53. In that case, it is unnecessary to provide the key supports, one for each key, and each key support can be configured to be common to plural keys.

The hammers 30 are supported on hammer pivot shafts 43 of the frame 40 so as to be vertically pivotable about the pivot shafts 43 (so that front and rear ends of each hammer 30 are able to pivot upward and downward about the pivot shaft 43). Each white key 10 is formed at its front part with a pendent piece 11 extending downward. The pendent piece 11 has its lower end that constitutes a hammer driving portion 12 including a damper member. This also applies to the black keys 20.

As shown in FIG. 1, each hammer 30 is formed into a rod shape, and has its engagement recess 31 into which the hammer pivot shaft 43 is engaged and its front and rear extensions 30*f*, 30*r* respectively extending forward and rearward with respect to the engagement recess 31. The engagement recess 31 is opened rearwardly. At a rear end of the rear extension 30*r*, there is provided a mass portion 32 where most of the mass of the hammer 30 is concentrated. The center of gravity G0 of the hammer 30 is positioned at a rear part of the rear extension 30*r*. Only from the viewpoint of effectively imparting inertia to the keys, an appropriate mass portion can be provided also at a tip end of the front extension 30*f* of each hammer 30. The front extension 30*f* is formed with a crab claw-like engagement portion having a long lower engagement portion 33 and a short upper engagement portion 34.

The lower and upper engagement portions 33, 34 of each hammer 30 are always in engagement with the hammer driving portion 12 of the corresponding white or black key 10 or 20, so that the hammer 30 is pivoted in forward and reverse directions in conjunction with the key. Although a detailed illustration is omitted, the hammer driving portion 12 is formed with an arcuate portion, as seen from side, not only on a lower side but also on an upper side thereof. The hammer driving portion 12 is slidably held between the lower and upper engagement portions 33, 34, whereby each hammer 30 is smoothly operable in both the key depression direction and the key release direction without rattle relative to the corresponding key 10 or 20. The lower and upper engagement portions 33, 34 respectively have a driven part 33*a* and a contact engagement portion 34*a*, which are in direct contact engagement with the hammer driving portion 12.

In FIG. 1, the white keys 10, the black keys 20, and the hammers 30 are shown in an initial state where none of the keys is depressed. Reference numerals 10-E and 30-E respectively denote the white key 10 and the hammer 30 which are in a key-depression end state.

Figure 2:
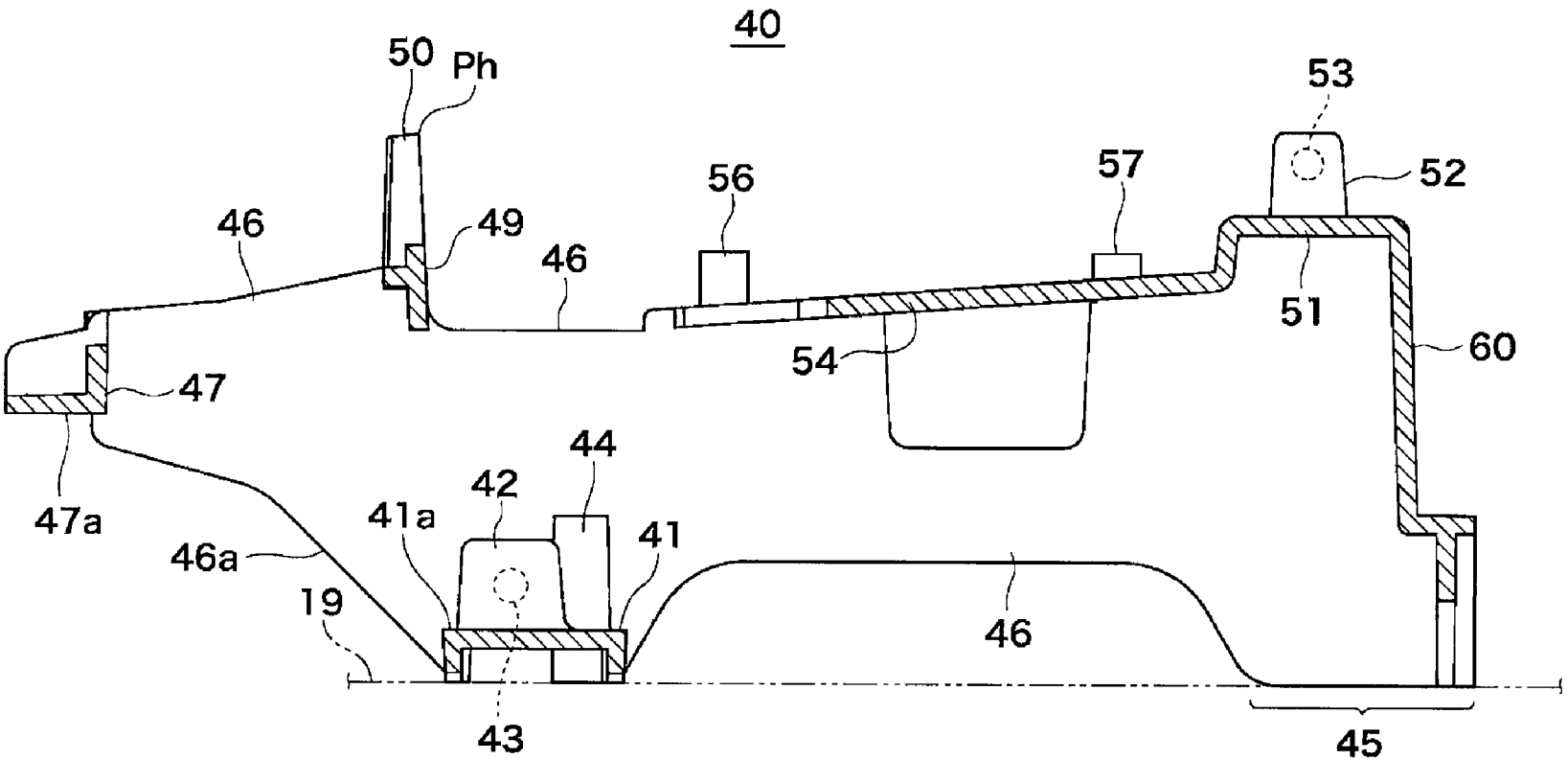
FIG. 2 is a longitudinal section view showing a frame of the keyboard apparatus.

The frame 40 is integrally formed by injection molding and fixedly disposed on a keybed 19 (see FIGS. 1 and 2). The keybed 19, without regard to its designation, can be any part of the musical instrument main body such as a bottom plate of a lower casing of the musical instrument.

As shown in FIG. 2, the frame 40 has a stopper mounting portion 47 formed at its frontmost part, and a key-guide coupling portion 49 formed rearward and upward of the stopper mounting portion 47. At a lowermost part of the frame 40, a front-side supporting portion 41 is formed slightly rearward of the key-guide coupling portion 49. At a lowermost rear part of the frame 40, there is formed a rear-side supporting portion 45. The front-side and rear-side supporting portions 41, 45 have their lower ends which are in direct contact with the keybed 19. The frame 40 is supported on the keybed 19 only at two places, i.e., the front-side and rear-side supporting portions 41, 45, whereby wastage of resin for fabrication of the frame 40 is suppressed.

Further, the frame 40 has a rear wall 60 thereof extending vertically upwardly from a rear end of the rear-side supporting portion 45, forwardly bent to form a horizontal step, and then again extending vertically upwardly, a key-support coupling portion 51 thereof forwardly extending from an upper end of the rear wall 60 and integrally formed with the rear wall 60, and a plate portion 54 thereof extending downwardly from a front end of the key-support coupling portion 51 to form a vertical step, and then extending forwardly and slightly downwardly. The plate portion 54 extends up to a longitudinally intermediate portion of the frame 40, which is located upward and rearward of the front-side supporting portion 41.

The stopper mounting portion 47, the key-guide coupling portion 49, the front-side supporting portion 41, the key-support coupling portion 51, and the plate portion 54 are integrally formed over the entire width of the frame 40 as viewed in the key arrangement direction. These frame portions are integrally connected with the rear-side supporting portion 45 and the rear wall 60 by means of vertical ribs 46 (see FIG. 2). The vertical ribs 46 are provided, one for plural keys. For example, two or three vertical ribs 46 are provided per octave, but this is not limitative.

As shown in FIG. 1, on a lower surface 47*a* of the stopper mounting portion 47, there is mounted an initial stopper 48 with which the lower engagement portions 33 of the hammers 30 are brought in contact and which restricts initial pivot positions of the hammers 30 in a key-depression forward stroke. In a non-key-depression state, due to the weights of the mass portions 32 acting to move the rear extensions 30*r* of the hammers 30 downward, the lower engagement portions 33 of the hammers 30 are in contact at their upper surfaces 33*b* with a lower surface 48*a* of the initial stopper 48, whereby the initial pivot positions of the hammers 30 are restricted. Since the lower engagement portions 33 of the hammers 30 are always in engagement with the hammer driving portions 12 of the white and black keys 10, 20, non-key-depression positions, i.e., key-depression initial positions of the white and black keys 10, 20 are indirectly restricted when the initial pivot positions of the hammers 30 are restricted, whereby height positions of key-depression surfaces, i.e., upper surfaces of the white and black keys 10, 20 in the non-key-depression state are made uniform.

Since the initial stopper 48 mounted to the lower surface 47*a* of the stopper mounting portion 47 is configured to contact at its lower surface 48*a* with the lower engagement portions 33 of the hammers 30, it is unnecessary to support the initial stopper 48 from below. Accordingly, it is unnecessary to provide the frame 40 with a thickened portion at a position vertically beneath the initial stopper 48, making it easy to reduce the area, as seen from side, of a front part of the frame 40.

On a lower surface of the plate portion 54, there is mounted an end stopper 55 with which the rear extensions 30*r* of the hammers 30 are brought in contact, whereby pivot end positions of the hammers 30 are restricted. When any of the keys 10, 20 is depressed, the hammer driving portion 12 of the depressed key drives the driven part 33*a* of the lower engagement portion 33 of the corresponding hammer 30, whereby the hammer 30 is pivoted counterclockwise in FIG. 1. Then, the rear extension 30*r* of the hammer 30 is brought in contact with the end stopper 55, thereby restricting a pivot end position, i.e., key-depression end position of the depressed key 10 or 20 and that of the corresponding hammer 30 in the key-depression forward stroke. When the key-depression is released from the key-depression end state, a reverse stroke starts. Specifically, the hammer 30 is pivoted clockwise due to the weight of its mass portion 32, and is restored to its initial position. At that time, the driven part 33*a* of the hammer 30 drives the hammer driving portion 12 of the released key 10 or 20, whereby the released key is returned to its initial position.

The initial stopper 48 and the end stopper 55 are each formed by a material having a damping function such as felt, and extend over the entire length of the frame 40 in the key arrangement direction. Alternatively, the stoppers 48, 55 can each be provided, one for each hammer 30. It should be noted that the initial and end stoppers 48, 55 can be made of a soft material such as elastomer and can be formed integrally with the frame 40 by two-color molding. On an upper surface of the plate portion 54, there are integrally formed a plurality of base-plate mounting portions 56, 57 on each of which a base plate 58 is fixedly screwed.

On the base plates 58, there are disposed key switches 59, etc. corresponding to respective ones of the keys 10, 20. The key switches 59 are each adapted to be depressed by the corresponding key 10 or 20 to detect the depression of the key. The musical instrument main body is provided with a musical tone generator (not shown) by which musical tones are generated based on a result of detection by the key switches 59.

As shown in FIGS. 1 and 2, key guides 50 extend upward from the key-guide coupling portion 49 and are formed integrally therewith. The key guides 50 are provided to respectively correspond to the keys and each adapted to guide a pivotal motion of the corresponding key. Alternatively, the key guides 50 can be fabricated separately from the frame 40 and then fixed thereto. On an upper surface 41*a* of the front-side supporting portion 41, there are formed pairs of projections 42, each pair for one hammer 30. Each hammer pivot shaft 43 is formed between the corresponding pair of projections 42. Both the key-guide coupling portion 49 and the stopper mounting portion 47 of the frame 40 are positioned forward and upward of the hammer pivot shafts 43.

Since the key-guide coupling portion 49 is positioned between the stopper mounting portion 47 and the hammer pivot shafts 43 as viewed in the longitudinal direction, the frame 40 can easily be integrally formed by injection die molding so as not to produce an undercut, and an amount of use of resin can be prevented from wastefully increasing.

Since the projections 42 and the hammer pivot shafts 43 are integrally formed with the front-side supporting portion 41, vertical space-saving can be achieved. In addition, it is possible to eliminate ribs or the like which are only for use for connecting the front-side supporting portion 41 to the hammer pivot shafts 43, whereby an amount of use of resin can be reduced. Since the plate portion 54 on which the key switches 59 are mounted is positioned rearward of the hammer pivot shafts 43, the area, as seen from side, of a front part of the frame 40 can easily be reduced, and an amount of use of resin can be reduced accordingly. Furthermore, since the key guides 50 are formed integrally with the frame 40 and upper end positions Ph of the key guides 50 correspond to an uppermost position of the frame 40, the height size of the frame 40 can be suppressed.

A plurality of bosses 44 are formed on the front-side supporting portion 41 integrally therewith. Although an illustration is omitted, a plurality of bosses are integrally formed also on the rear-side supporting portion 45. By using screws threadedly engaging screw holes (not shown) formed in the bosses of the front-side and rear-side supporting portions 41, 45, the frame 40 is fixed to the keybed 19 constituting a part of the musical instrument main body.

On an upper surface of the key-support coupling portion 51, there are integrally formed pairs of projections 52, each pair for each key. On each of opposed faces of each pair of projections 52, the key support 53 is formed.

When the keyboard apparatus is in use, the initial stopper 48, the key guides 50, the hammer pivot shafts 43, the key supports 53, the key switches 59, and the end stopper 55 are not in contact or engagement with the frame 40 but in contact or engagement with other constituent element of the keyboard apparatus. They serve as constituent elements that help the frame 40 function as a key frame for appropriately supporting the keys 10, 20 and a hammer frame for appropriately supporting the hammers 30. Hereinafter, these constituent elements will be referred to as the frame function parts. The front-side and rear-side supporting portions 41 and 45 each have a function of being in direct contact with and being fixed to the keybed 19 also serve as frame function parts.

On the other hand, the key-guide coupling portion 49, the front-side supporting portion 41, the key-support coupling portion 51, and the plate portion 54 serve to couple together a plurality of same constituent elements (such as key guides 50, hammer pivot shafts 43, key supports 53, and key switches 59) as seen in the key arrangement direction. The stopper mounting portion 47 on which the initial stopper 48 is mounted is integral and continuous as viewed in the key arrangement direction. The plate portion 54 on which the end stopper 55 is mounted and on which the base plates 58 are mounted via the base-plate mounting portions 56, 57 is also integral and continuous in the key arrangement direction. The front-side and rear-side supporting portions 41, 45 disposed in contact with the keybed 19 to receive reaction forces from the keybed 19 at the time of key depression or the like are integral and continuous as viewed in the key arrangement direction. Thus, the key-guide coupling portion 49, the front-side supporting portion 41, the key-support coupling portion 51, the plate portion 54, the stopper mounting portion 47, and the rear-side supporting portion 45 will be referred to as the integral continuous parts.

Each of these integral continuous parts can be defined as a part which is integrally formed on the frame 40, is continuous and integral over a region including plural keys as viewed in the key arrangement direction, is applied with an external force directly or via a frame function part, and/or is mounted with a constituent element configured separately from the frame 40.

As shown in FIG. 2, front lower edges 46*a* of the vertical ribs 46 obliquely extend upwardly from the front-side supporting portion 41 to the stopper mounting portion 47. In a longitudinal region between the stopper mounting portion 47 and the front-side supporting portion 41, each of the front lower edges 46*a* of the vertical ribs 46 constitutes a lowermost edge, as seen from side, of the frame 40, and the height position of the front lower edge 46*a* (i.e., the height position of the lowermost part of the frame 40) becomes higher at a longitudinal position closer to the stopper mounting portion 47. Thus, the area of the front part, as seen from side, of the frame 40 becomes small and an amount of use of resin is reduced.

When assembled to the frame 40, each hammer 30 is inserted into the frame 40 from front, with its longitudinal axis made parallel to the longitudinal direction of the frame 40. Since the engagement recess 31 of the hammer 30 is opened rearwardly, the engagement recess 31 is naturally fitted onto the hammer pivot shaft 43 when the hammer 30 is moved rearward while its longitudinal axis is kept parallel to the longitudinal direction of the frame 40.

Since both the stopper mounting portion 47 and the plate portion 54 to which the initial stopper 48 and the end stopper 55 are mounted, respectively, are positioned upward of the hammer pivot shafts 43, these portions 47, 54 do not hinder the assembly of the hammers 30 to the frame 40 and hence the assembly can made with ease. Since the key-guide coupling portion 49 mounted with the key guides 50 is also positioned upward of the hammer pivot shafts 43, the key-guide coupling portion 49 does not hinder the assembly. Since the stopper mounting portion 47 and the plate portion 54 are respectively disposed on the opposite sides of the hammer pivot shafts 43 as viewed in the longitudinal direction, the frame 40 can easily be integrally formed. The stopper mounting portion 47 and the key-guide coupling portion 49 are located at different longitudinal positions with respect to the hammer pivot shafts 43. Also in this respect, it is easy to carry out injection die molding so as not to produce undercut.

Generally, if the distance from the upper surface 33*b* of the lower engagement portion 33 of each hammer 30 to the corresponding hammer pivot shaft 43 becomes long, a speed at which the upper surface 33*b* of the lower engagement portion 33 contacts the initial stopper 48 becomes high, and hence the initial stopper 48 is largely deformed by repetitive contacts. If the thickness of the initial stopper 48 is thickened so as to withstand the impact, a variation in thickness becomes large between different portions of the stopper 48, resulting in a variation in height position between the key-depression surfaces of the keys 10, 20. If the distance from the upper surface 33*b* of the lower engagement portion 33 of each hammer 30 to the hammer pivot shaft 43 is excessively large, warpage and deformation of the hammer 30 in a region between the upper surface 33*b* and the hammer pivot shaft 43 affect the key-depression initial position of the corresponding key 10 or 20, resulting in a variation in height position between the key-depression surfaces.

In this embodiment, as shown in FIG. 1, the hammers 30 are each designed such that the distance from the upper surface 33*b* of the lower engagement portion 33 to the corresponding hammer pivot shaft 43 (or engagement recess 31) is shorter than the distance from the hammer pivot shaft 43 to the center of gravity G0 of the hammer 30, thereby reducing the affection of warpage and deformation of the hammer 30 in the region between the hammer pivot shaft 43 and the upper surface 33*b* upon the height position of the key-depression surface of the corresponding key 10 or 20. In addition, the speed at which upper surface 33*b* contacts the initial stopper 48 is lowered, thereby suppressing the initial stopper 48 from being deformed by repetitive contacts and suppressing a variation in height position between the key-depression surfaces.

On the other hand, if the distance from the upper surface 33*b* to the hammer pivot shaft 43 is excessively short, a slight thickness difference in the initial stopper 48 produces a variation in the height positions of the key-depression surfaces. In this embodiment, the upper surface 33*b* of the lower engagement portion 33 is positioned on the side opposite from the hammer pivot shaft 43 with respect to the driven part 33*a*, thereby ensuring some appropriate length between the hammer pivot shaft 43 and the upper surface 33*b*, so that a variation in the thickness of the initial stopper 48 less affects the height positions of the key-depression surfaces.

According to this embodiment, the front-side and rear-side supporting portions 41, 45 of the frame 40 are in contact with the keybed 19 at locations vertically beneath the hammer pivot shafts 43 and the key supports 53, respectively. The frame 40 is therefore supported on the keybed 19 only at two places, i.e., the supporting portions 41, 45. As a result, heavy loads to support the hammers 30 and the keys 10, 20 are perpendicularly applied to the front-side and rear-side supporting portions 41, 45 which are front-side and rear-side contact portions, thereby easily suppressing wastage of resin for reinforcement. Only from the viewpoint of load support, the frame 40 can be fixed at parts other than the supporting portions 41, 45 to the keybed 19 although such a load support structure is not much advantageous in a point to prevent the wastage of resin.

Furthermore, since the front lower edges 46*a* of the vertical ribs 46 constituted as the lowermost part, as seen from side, of the frame 40 become higher at a position closer to the stopper mounting portion 47 between the hammer pivot shafts 43 and the stopper mounting portion 47, the area of the front part of the frame 40 as seen from side can be reduced, whereby the amount of use of resin can be suppressed to achieve light weight and reduced cost of the frame 40. In addition, since the height positions of the front lower edges 46*a* of the vertical ribs 46 become higher toward the front side of the frame 40, it is easy to make the frame 40 look to be thin as seen from front and hence the degree of freedom in designing the frame 40 can be increased.

Moreover, with this embodiment, the hammers 30 are in contact with the lower surface 48*a* of the initial stopper 48 in the non-key-depression state, whereby the initial pivot positions of the hammers 30 in the key-depression forward stroke are restricted and hence the key-depression initial positions of the keys 10, 20 are restricted. Accordingly, when the hammer 30 corresponding to a released key returns to the non-key-depression state, the hammer 30 is brought in contact with the initial stopper 48 at its front extension 30*f* which is a mass-unconcentrated half of the hammer 30, whereby a contact force with which the hammer 30 contacts the initial stopper 48 can be made small, thus making it possible to reduce the required thickness of the initial stopper 48 and easily make the height positions of the key-depression surfaces in the non-key-depression state uniform.

It should be noted that in this embodiment, each hammer 30 is formed with the engagement recess 31 and the frame 40 has the hammer pivot shafts 43, however, each hammer can be formed with a shaft portion and the frame 40 can be formed with engagement recesses, so that the male-female connection of the hammer and the frame is reversed from that in the embodiment.

Second Embodiment

In the first embodiment, the key guides 50 for white keys 10 and those for black keys 20 are disposed at the same position as viewed in the longitudinal direction. In a second embodiment, on the other hand, key guides for white keys 10 and those for black keys 20 are disposed at different longitudinal positions.

Figure 3A:
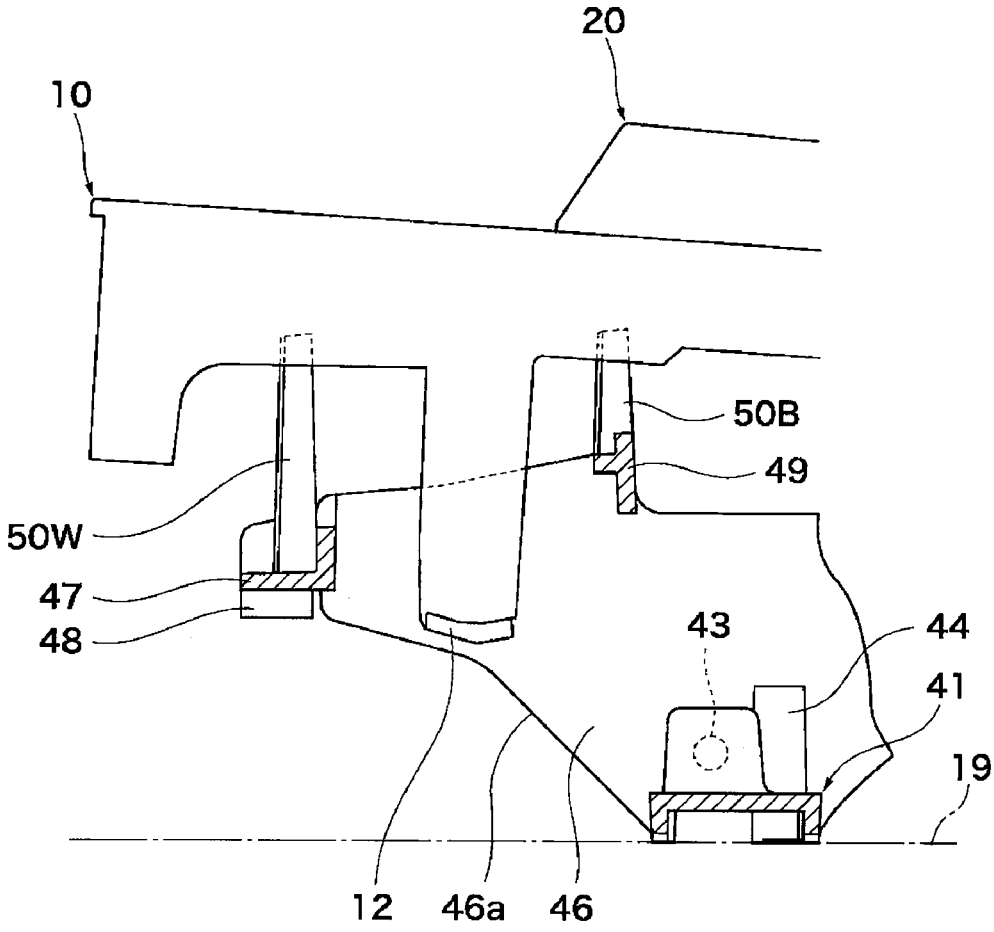
FIG. 3A is a side view showing the internal construction of a front part of a keyboard apparatus according to a second embodiment of this invention.

FIG. 3A shows in side view the internal construction of a front part of a keyboard apparatus according to the second embodiment. As shown in FIG. 3A, key guides 50 are configured, distinguishing between key guides 50W for white keys 10 and key guides 50B for black keys 20. Specifically, the key guides 50B are each integrally formed with the key-guide coupling portion 49 as with the first embodiment. On the other hand, the key guides 50W are each integrally formed on the stopper mounting portion 47 so as to extend upwardly therefrom. In other respects, the second embodiment is the same or similar to the first embodiment.

According to the second embodiment, effects similar to those attained by the first embodiment can be achieved. In addition, the white keys 10 can be guided satisfactorily by the key guides 50W disposed forward of the key guides 50B. The stopper mounting portion 47 also functions as key-guide mounting portions on which the key guides 50W are mounted, whereby a vertical space-saving of the frame 40 can be achieved, and an amount of use of resin can be reduced by eliminating, e.g., ribs which are used only for connecting the key-guide mounting portions for key guides 50W to the stopper mounting portion 47.

Figure 3B:
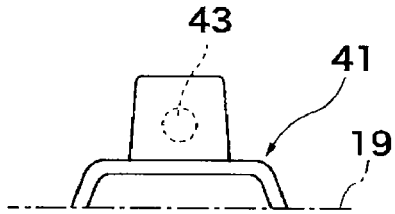
FIG. 3B is a side view showing a modification of a front-side supporting portion in the front part of the keyboard apparatus.

As shown in FIG. 3B, each of the front-side supporting portions 41 can be formed into a shape in which lower front and rear parts thereof respectively expand forward and rearward as seen from side.

In the first and second embodiments, the longitudinal positional relation between the stopper mounting portion 47 and the key-guide coupling portion 49 can be reversed. Alternatively, the key guides 50 and the key-guide coupling portion 49 can be eliminated. For example, the keys 10, 20 are made pivotable about a wide width hinge and the key supports 53 are eliminated.

In such cases, to reduce the area of a front part of the frame 40 as seen from side to thereby suppress an amount of use of resin, the vertical ribs 46 can be configured such that the front lower edges 46*a* of the ribs 46 each constitute the lowermost part, as seen from side, of the frame 40 in a longitudinal region between the hammer pivot shafts 43 and either the stopper mounting portion 47 or the key-guide coupling portion 49, whichever positioned forward in the longitudinal direction.

Only from the viewpoint of configuring the hammers 30 such that a mass-unconcentrated half of each hammer 30 is adapted for contact with the lower surface 48*a* of the initial stopper 48 to thereby reduce a contact force with which the hammers 30 contact the initial stopper 48, the hammers 30 in the first and second embodiments can be modified as described below.

Figure 4A:
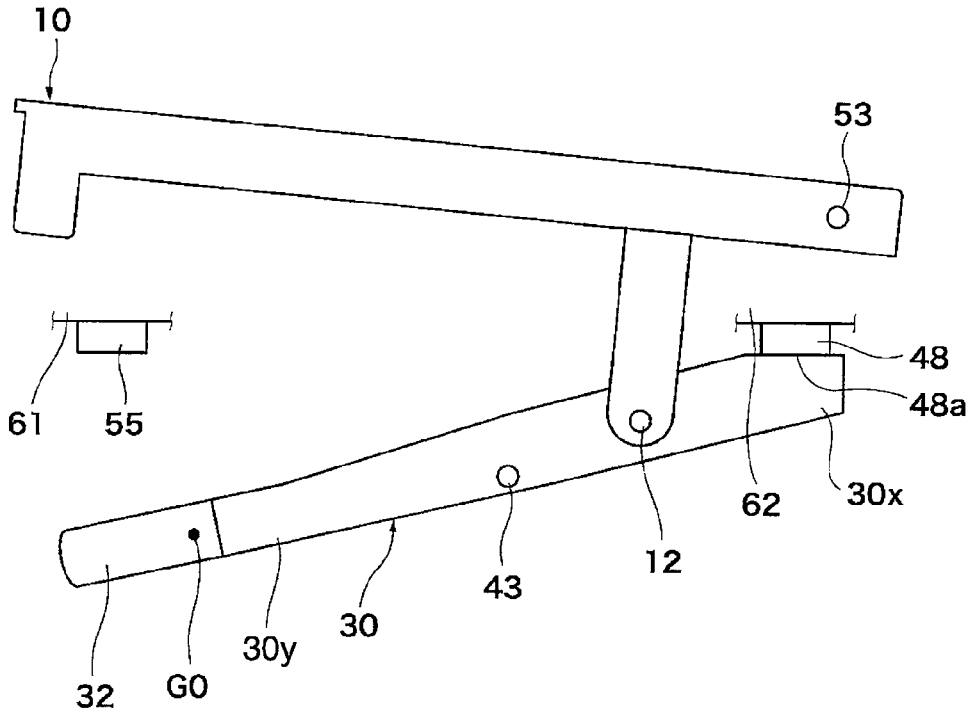
FIG. 4A is a side view schematically showing a first modification of a white key and a corresponding hammer of the keyboard apparatus.

In a first modification schematically shown in FIG. 4A, the mass portion 32 is provided at a tip end of the front extension 30*y* with the hammer 30 reversed in the front-and-rear direction. Furthermore, the end stopper 55 is mounted to the stopper mounting portion 61 formed in a front part of the frame 40, and the initial stopper 48 is mounted to the stopper mounting portion 62 formed in a rear part of the frame 40. The hammer driving portion 12 of each white key 10 drives a rear extension 30*x* of the corresponding hammer 30 disposed rearward of the hammer pivot shaft 43 of the hammer 30. This also applies to the black key 20 (not shown). In a key-non-depression state, the rear extension 30*x* of each hammer 30 is in contact by its own weight with the lower surface 48*a* of the initial stopper 48, whereby the initial pivot position of the hammer 30 is restricted. In conjunction with a key-depression operation, a front extension 30*y* of the corresponding hammer 30 moves upward and is made contact with the end stopper 55, whereby the pivot end position of the hammer 30 is restricted.

Only from the similar viewpoint, both the initial stopper 48 and the end stopper 55 for restricting the initial pivot positions and the pivot end positions of the hammers 30 can be disposed at either a front part or a rear part of the frame 40. In a second modification schematically shown in FIG. 4B, both the initial stopper 48 and the end stopper 55 are disposed in a front part of the frame 40. Specifically, the end stopper 55 is mounted to a stopper mounting portion 63 formed at a front part of the frame 40. The lower engagement portion 33 of each hammer 30 is adapted for contact with the upper surface of the end stopper 55, whereby the pivot end position of the hammer 30 is restricted.

Figure 4B:
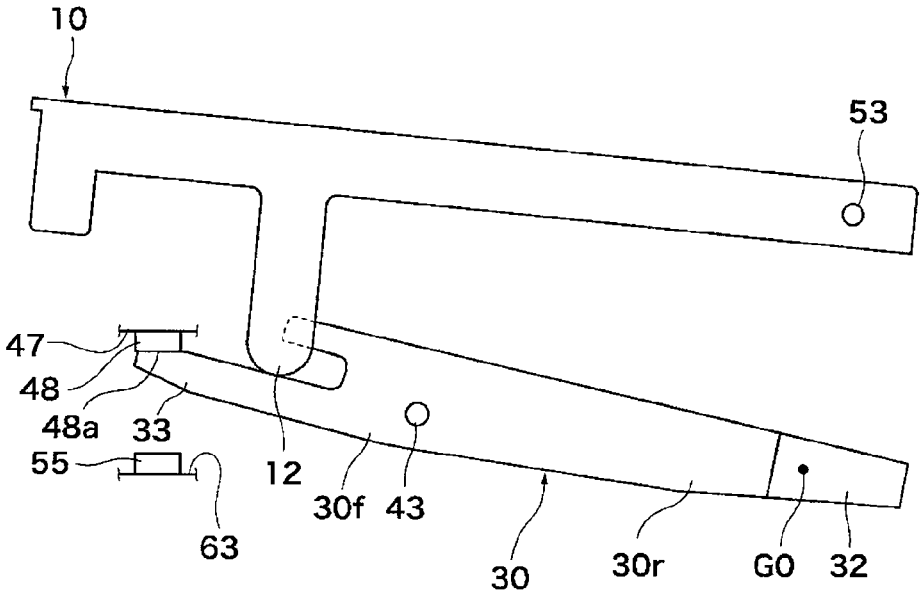
FIG. 4B is a side view schematically showing a second modification of the white key and the hammer.

As an alternative arrangement where both the stoppers 48, 55 are disposed at a rear part of the frame 40, the first modification shown in FIG. 4A is modified such that the stopper mounting portion 63 shown in FIG. 4B is formed below the rear extension 30*x* at a rear part of the frame 40 and the end stopper 55 is disposed on the stopper mounting portion 63. In that case, the rear extension 30*x* of each hammer 30 is brought in contact with an upper surface of the end stopper 55, whereby the pivot end position of the hammer 30 is restricted.

What is claimed is:

1. A keyboard apparatus comprising:

a frame having a key support and hammer supports and integrally formed by resin, said frame being adapted to be supported on a musical instrument main body;

a plurality of keys mutually juxtaposed and each supported by a corresponding one of the key supports for pivotal motion when depressed;

a plurality of hammers mutually juxtaposed so as to correspond to respective ones of said keys, each of said hammers being supported by a corresponding one of the hammer supports at a location below the corresponding key so as to pivot about the hammer support in conjunction with the corresponding key and impart inertia to a pivotal motion of the key;

an initial stopper having a lower surface and provided on said frame integrally therewith or separately therefrom; and an initial stopper mounting portion integrally formed on said frame and mounted with said initial stopper, wherein said hammers are adapted to be in contact with the lower surface of said initial stopper in a non-key-depression state, whereby initial pivot positions of said hammers in a key-depression forward stroke are restricted to thereby restrict key-depression initial positions of said keys, wherein said hammers each have a stopper contacting portion adapted to be in contact with the lower surface of said initial stopper in the non-key-depression state, and a distance from the stopper contacting portion of each of said hammers to a corresponding one of the hammer supports is shorter than a distance from the hammer support to a center of gravity of the hammer.

2. The keyboard apparatus according to claim 1, wherein said hammers each have a driven portion adapted to be driven by the corresponding key so as to pivot in conjunction with the key, and said hammers each have a stopper contacting portion on a side opposite from a corresponding one of the hammer supports with respect to the driven portion of the hammer, said stopper contacting portion being adapted to be in contact with the lower surface of said initial stopper in the non-key-depression state.

3. The keyboard apparatus according to claim 1, including:

an end stopper provided on said frame integrally therewith or separately therefrom and adapted for contact with said hammers to thereby restrict key-depression end positions of said keys in the key-depression forward stroke; and an end-stopper mounting portion integrally formed on said frame and mounted with said end stopper, wherein both said initial-stopper mounting portion and said end-stopper mounting portion are positioned upward of the hammer supports.

4. A keyboard apparatus comprising:

a frame having a key support and hammer supports and integrally formed by resin, said frame being adapted to be supported on a musical instrument main body;

a plurality of keys mutually juxtaposed and each supported by a corresponding one of the key supports for pivotal motion when depressed;

a plurality of hammers mutually juxtaposed so as to correspond to respective ones of said keys, each of said hammers being supported by a corresponding one of the hammer supports at a location below the corresponding key so as to pivot about the hammer support in conjunction with the corresponding key and impart inertia to a pivotal motion of the key;

an initial stopper having a lower surface and provided on said frame integrally therewith or separately therefrom;

an initial stopper mounting portion integrally formed on said frame and mounted with said initial stopper, wherein said hammers are adapted to be in contact with the lower surface of said initial stopper in a non-key-depression state, whereby initial pivot positions of said hammers in a key-depression forward stroke are restricted to thereby restrict key-depression initial positions of said keys, an end stopper provided on said frame integrally therewith or separately therefrom and adapted for contact with said hammers to thereby restrict key-depression end positions of said keys in the key-depression forward stroke; and an end-stopper mounting portion integrally formed on said frame and mounted with said end stopper, wherein said initial-stopper mounting portion and said end-stopper mounting portion are respectively positioned on opposite sides of the hammer supports as viewed in a longitudinal direction.

5. A keyboard apparatus comprising:

a frame having a key support and hammer supports and integrally formed by resin, said frame being adapted to be supported on a musical instrument main body;

a plurality of keys mutually juxtaposed and each supported by a corresponding one of the key supports for pivotal motion when depressed;

a plurality of hammers mutually juxtaposed so as to correspond to respective ones of said keys, each of said hammers being supported by a corresponding one of the hammer supports at a location below the corresponding key so as to pivot about the hammer support in conjunction with the corresponding key and impart inertia to a pivotal motion of the key;

an initial stopper having a lower surface and provided on said frame integrally therewith or separately therefrom; and an initial-stopper mounting portion integrally formed on said frame and mounted with said initial stopper, wherein said hammers each have a first half having a mass concentrated portion and a second half located on a side opposite from the first half with respect to a corresponding one of the hammer supports, and the second halves of said hammers in a non-key-depression state are adapted to be in contact with the lower surface of said initial stopper due to own weights of said hammers, whereby initial pivot positions of said hammers in a key-depression forward stroke are restricted to thereby restrict key-depression initial positions of said keys.

6. The keyboard apparatus according to claim 5, wherein said hammers each have a stopper contacting portion adapted to be in contact with the lower surface of said initial stopper in the non-key-depression state, and a distance from the stopper contacting portion of each of said hammers to a corresponding one of the hammer supports is shorter than a distance from the hammer support to a center of gravity of the hammer.

7. The keyboard apparatus according to claim 5, wherein said hammers each have a driven portion adapted to be driven by the corresponding key so as to pivot in conjunction with the key, and said hammers each have a stopper contacting portion on a side opposite from a corresponding one of the hammer supports with respect to the driven portion of the hammer, said stopper contacting portion being adapted to be in contact with the lower surface of said initial stopper in the non-key-depression state.

8. The keyboard apparatus according to claim 5, including:

an end stopper provided on said frame integrally therewith or separately therefrom and adapted for contact with said hammers to thereby restrict key-depression end positions of said keys in the key-depression forward stroke; and an end-stopper mounting portion integrally formed on said frame and mounted with said end stopper, wherein both said initial-stopper mounting portion and said end-stopper mounting portion are positioned upward of the hammer supports.

9. The keyboard apparatus according to claim 5, including:

an end stopper provided on said frame integrally therewith or separately therefrom and adapted for contact with said hammers to thereby restrict key-depression end positions of said keys in the key-depression forward stroke; and an end-stopper mounting portion integrally formed on said frame and mounted with said end stopper, wherein said initial-stopper mounting portion and said end-stopper mounting portion are respectively positioned on opposite sides of the hammer supports as viewed in a longitudinal direction.

* * * * *